United States Patent [19]

Grosso et al.

[11] Patent Number: 5,015,549

[45] Date of Patent: May 14, 1991

[54] COMPOSITION AND ELECTROPHOTOGRAPHIC USE OF MICROCAPSULAR PHOTOACTIVE TONER PARTICLES

[75] Inventors: Paul V. Grosso, West Hartford; Michael J. Morgan, Northford; Feagin A. Wing, Jr., Farmington, all of Conn.; Roger W. Day, Louisville, Ky.

[73] Assignee: Olin Corporation, Cheshire, Conn.

[21] Appl. No.: 411,938

[22] Filed: Sep. 25, 1989

Related U.S. Application Data

[63] Continuation-in-part of Ser. No. 171,614, Mar. 23, 1988.

[51] Int. Cl.[5] ..... G03G 9/12

[52] U.S. Cl. ..... 430/45; 430/111; 430/138; 428/402.21; 428/402.22; 503/215

[58] Field of Search ..... 430/138, 111, 45

[56] References Cited

U.S. PATENT DOCUMENTS

| | | | |
|---|---|---|---|
| 3,179,600 | 4/1965 | Brockett | 252/188.3 |
| 3,672,935 | 6/1972 | Miller et al. | 117/36.8 |
| 3,732,120 | 5/1973 | Brockett et al. | 117/16 |
| 3,737,410 | 6/1973 | Mueller | 260/59 |
| 3,832,170 | 8/1974 | Nagamatsu et al. | 96/1.2 |
| 3,833,293 | 9/1974 | Serio et al. | 355/17 |
| 3,854,942 | 12/1974 | Akman | 96/1.2 |
| 4,501,809 | 2/1985 | Hiraishi et al. | 430/138 |
| 4,529,681 | 7/1985 | Usami | 430/138 |
| 4,554,235 | 11/1985 | Adair et al. | 430/138 |
| 4,647,182 | 3/1987 | Pierce | 355/4 |
| 4,869,981 | 9/1989 | Wing | 430/47 |

FOREIGN PATENT DOCUMENTS

| | | |
|---|---|---|
| 2113860 | 8/1983 | United Kingdom . |
| 2133899 | 2/1986 | United Kingdom . |

OTHER PUBLICATIONS

Chemical Week, "Mead Brings Color to Business", Dec. 13, 1987, pp. 32–33.

Chemical and Engineering News, "New Color Technology Uses Microcapsules", Jan. 11, 1988, p. 23.

*Primary Examiner*—David Welsh

*Attorney, Agent, or Firm*—Dale L. Carlson

[57] ABSTRACT

A positive or negative latent image can be developed with negatively or positively charged toner particles, respectively, that are microcapsular. The shell material of the toner particles is a melamine-formaldehyde resin or a starch-based material. The core is a liquid solution comprising at least a liquid, ethylenically unsaturated monomer, a leuco dye and a photoinitiator.

22 Claims, No Drawings

COMPOSITION AND ELECTROPHOTOGRAPHIC USE OF MICROCAPSULAR PHOTOACTIVE TONER PARTICLES

This application is a continuation-in-part of co-pending U.S. Application Ser. No. 07/171,614, filed on Mar. 23, 1988.

This invention relates generally to electrostatic imaging systems and, more particularly, to a microencapsulated toner composition for use in a method for providing multicolor images from a single toner bath.

Conventional multicolor electrostatic imaging systems utilize a separate toner bath to develop each desired color. This use of separate toner baths is relatively expensive from the standpoint of equipment complexity, cost, maintenance, and processing time expended. It also requires multiple mechanical registrations to produce the multicolor image—a requirement fraught with the potential for error.

As an alternative to the use of toners and electrostatic imaging, a recent development in the industry utilizes an imaging sheet of paper completely coated on one side with microencapsulated color precursors. A portion of the microcapsules on the sheet is selectively hardened by exposure to light. The microcapsules having the desired color precursor in the image areas have liquid cores which remain unhardened. These unhardened microcapsules are then ruptured to release liquid color precursor. The thus-released color precursor is contacted with a color developer to provide the color image, generally by transfer to a developer sheet via pressure contact of the imaging sheet with the developer sheet. Alternately, the color precursor-containing capsules are coated directly on a layer of developer material, which itself had previously been coated on a paper support.

By way of illustration, such a transfer imaging system containing microencapsulated color precursors is disclosed in U.S. Pat. No. 4,554,235, assigned to Mead Corporation. In a variation of this type of system, U.S. Pat. No. 4,501,809, assigned to Mitsubishi Paper Company, discloses a recording sheet containing two different types of photo- and pressure-sensitive microcapsules—one set containing color precursors and the other set containing color developer. Upon rupture of unhardened microcapsules on the recording sheet after selective exposure of the recording sheet to light in imagewise registration with an image to be copied, a color image is formed on the recording sheet.

The color imaging systems illustrated by the above-cited patents possess a common disadvantage. Both systems utilize an imaging or developer sheet containing microcapsules across a full surface of the sheet. Since in many color imaging applications the desired color image rarely occupies the full sheet, and, indeed, often occupies less than half of the full sheet, there is a significant amount of waste attributable to the unused microcapsules and associated color precursor or developer contained on the non-imaged areas of the sheet. In addition, there is a substantial time and energy waste attributable to the need for photohardening the "unused" waste microcapsules using, for example, a scanning laser.

In view of the above, a new system for multicolor imaging utilizing microcapsules which does not result in such substantial waste of microcapsules and the associated colorant materials, plus wasted time and energy due to the need for photohardening of the waste microcapsules, would be highly desired by the color imaging community.

Such an electrostatic imaging system is described in detail in co-pending, commonly assigned U.S. Pat. Applications Ser. Nos. 171,614 and 308,713. The compositions described in the instant application are suitable for use in the systems and processes described in Ser. Nos. 171,614 and 308,713, the disclosures of which are incorporated herein by reference in their entirety.

The toner particles of the present invention afford a simplicity of utilization, particularly with regard to multi-color and full-color imaging systems, that is nowhere afforded by the prior art to the knowledge of the present inventors. More specifically, in contrast to the techniques developed by Mead Corporation and Moore Business Forms which require the use of one or two sheets of specially coated paper or plastic film containing microcapsules and/or developer across the full surface thereof for developing an image, an electrostatic imaging technique associated with the toner particles of the present invention can utilize plain bond paper, rag paper, cardboard, plastic films, or another such substrate. In addition, the toner particle composition possesses a distinct advantage over the prior art, inasmuch as the electrostatically-depositable toner particles carry their own color developer, and are thereby color-self-developing.

Each individual toner particle comprises a shell and a core. The shell is fabricated from a polymeric material. The shell possesses a charge characteristic to render the toner particle electrostatically depositable. At a minimum, the core contains a colorless, chromogenic material and a solvent for the chromogenic material. Optionally, the core additionally contains an ethylenically-unsaturated monomer and a polymerization initiator. The polymerization initiator is capable of initiating the polymerization of the monomer under the influence of a specified wavelength of actinic radiation, or heat, or another form of energy. A developer is adsorbed to, coated on, or otherwise bound to the outer surface of the shell of the toner particle.

If desired, the dry toner particles produced as described above and containing the developer on the individual microcapsules can be dispersed in a non-polar organic solvent, such as ISOPAR ® G or ISOPAR ® H, products of Exxon Corporation, preferably in conjunction with other toner additives such as dispersants and/or charge-directing agents, as is known in the art, to provide a liquid reprographic toner composition. When using such a liquid composition, it is preferred that the dispersed particles be in a non-polar organic medium having a low dielectric constant of 3.5 or less and a high electrical resistance of $10^9$ Ohms-centimeters or more. Suitable organic media include the n-paraffin hydrocarbons, cycloaliphatic hydrocarbons, aromatic hydrocarbons, halogenated aliphatic hydrocarbons, and preferably, isoparaffin hydrocarbons, such as the above-mentioned ISOPAR ® compounds.

The toner composition useful in the method of the present invention may be a toner blend. This blend contains at least two different types of toner particles in order to provide at least two (preferably at least three or four) different color precursors. As used herein, the term "toner particle" is intended to designate any of a variety of particle forms which can be used to contain or carry and isolate color precursors.

The method of the present invention provides the above-described advantageous result using a multi-step method of color imaging employing the toner particles of the present invention. In the first two steps, a latent image and then an uncolored, toned image are formed in typical electrostatic fashion on a support, typically a drum, web, or sheet. In the subsequent steps, the desired color is determined by utilizing the photosensitivity differences of the toner particles containing the individual color precursors. These photosensitivity differences are suitably produced by using a different photoinitiator for each separate color Precursor employed in the toner blend.

In a typical electrostatic method, the latent image is formed by known means. First, a blanket positive or negative charge is typically applied to a surface photoreceptor substrate, suitably a photoconductive drum, web, or sheet, by means of a corona. Portions of the surface of the photoreceptor are then selectively discharged. This selective discharge is suitablY effected using light (desirably using a laser light source). The surface of the selectively discharged photoconductor contains a latent image on either the charged portions of the surface (for positive development) or on the uncharged portions of the surface (for reversal development). (An alternate method for forming the latent image typically uses an ion-generating cartridge or a charging head ("stylus") to selectively deposit charges on a dielectric substrate, to provide charged and uncharged portions of the substrate, as is well known in the art.) Once the latent image has been formed on the photoreceptor, a toner blend having a charge characteristic either opposite from (for positive development) or the same as (for reversal development) the charge on the selectively discharged photoreceptor is then applied onto the surface of the photoreceptor. Typically, the toner blend is applied to the photoconductive surface from a liquid toner bath, or in the case of a dry toner by means of a magnetic brush. A variety of electrostatic development methods are usable and known to practitioners of the art. The photosensitive toned image on the photoreceptor is then selectively hardened (i.e., photopolymerized) or in some embodiments softened, (i.e., photodepolymerized) by exposure to radiation of a specified wavelength. This photopolymerization or photodepolymerization is carried out to cause only toner particles containing desired color precursors to be rupturable for releasing said color precursors. For example, if a yellow image is desired, the toned image will be exposed to wavelengths of light which will cause the toner particles containing the cyan, magenta, and black color precursors to be hardened. Likewise if a green image is desired, the toned image will be exposed to wavelengths of light which cause the toner particles containing the magenta and black color precursors to selectively harden. All known colors can be likewise caused to form by exposure of toner particles to the appropriate wavelengths of light and then completing the imaging process. Additionally, the deliberate creation of partially hardened toner particles will give rise to intensity variations of the color produced.

The toned image, composed of both hardened (or harder) and rupturable (or softer) toner particles, is then transferred to a copy sheet by known procedures. For example, this transfer is suitably effected by passing the substrate to be printed, such as a copy sheet of paper or a transparent film, between the photoreceptor and a transfer corona, thereby causing the toner particles to transfer from the photoreceptor to the copy sheet.

Once on the copy sheet, the rupturable toner particles of those making up the toned image are ruptured, typically by radiation, heat, pressure or a combination of these procedures (preferably by pressure) to release the desired color precursors. These desired color precursors are then developed by reaction of the released color precursors with the self-contained developer.

The color precursors useful in the present invention are preferably oil-soluble color formers which will produce a color upon reaction with a developer material in the presence of a carrier oil. Substantially any of the precursors conventionally used in carbonless paper can be used in the present invention. In general, these materials are colorless electron-donating tYPe compounds. Representative examples of such color formers include substantially colorless compounds having in their partial skeleton a lactone, a lactam, a sultone, a spiropyran, an ester or an amido structure. Specifically, there are triarylmethane compounds, bisphenylmethane compounds, xanthene compounds, thiazine compounds, spiropyran compounds and the like. Mixtures of the respective color precursors can be used if desired.

Some representative leuco dye color precursors which give yellow, cyan, and magenta images are shown below.

Yellow color precursors:

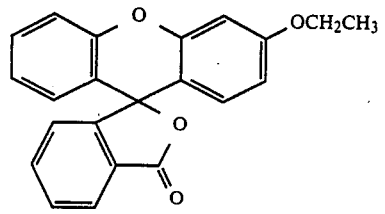

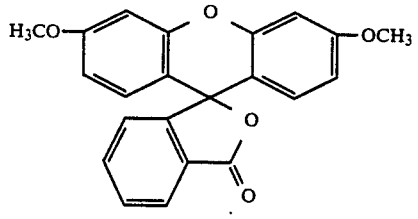

Cyan color precursor:

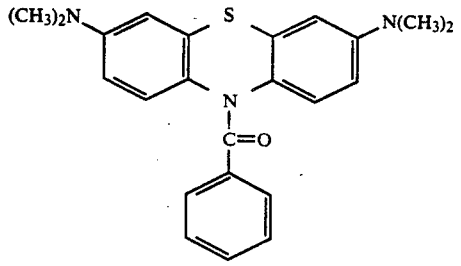

-continued

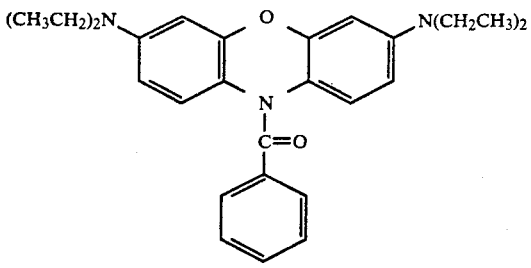

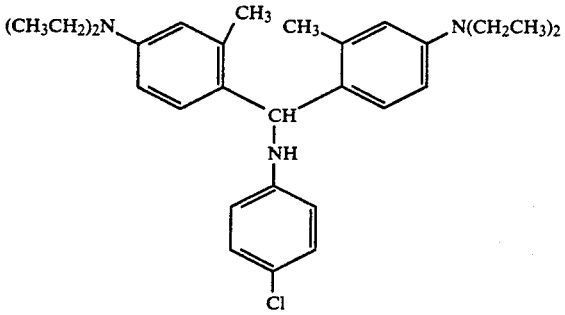

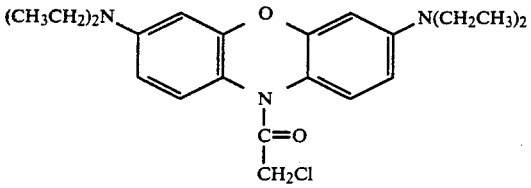

Magenta color precursors:

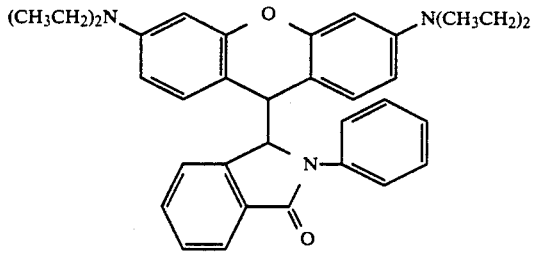

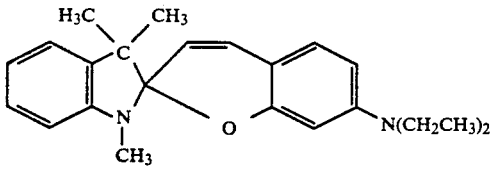

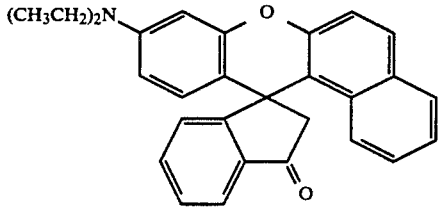

The color precursors used in the present invention must be non-absorbing with respect to the exposure radiations relied upon to cure the photosensitive encapsulate since the color precursors are either present in the encapsulate or the exposure radiation must pass through the color precursor to expose the encapsulate. Hence, colorless electron donating type compounds are preferred for use in the present invention. Of course, a completely colorless color precursor is difficult to obtain and a small degree of coloration may be tolerated in the color precursor as long as it does not interfere with exposure. Developer materials useful in the present invention include those conventionally employed in carbonless paper technology and are well known. Illustrative specific examples are clay minerals such as acid clay, active clay, attapulgite, etc.; organic acids such as tannic acid, gallic acid, propyl gallate, etc.; acid polymers such as phenol-formaldehyde resins, phenol acetylene condensation resins, condensates between an organic carboxylic acid having at least one hydroxy group and formaldehyde, etc.; metal salts of aromatic carboxylic acids such as zinc salicylate, tin salicylate, zinc 2-hydroxy naphthoate, zinc 3,5 di-tert butyl salicylate; oil-soluble metal salts of phenol-formaldehyde novolak resins (e.g., see U.S. Pat. Nos. 3,672,935; 3,732,120; and 3,737,410) such as zinc-modified oil soluble phenol-formaldehyde resin; and mixtures thereof. Preferred developers are the acid developers. Useful acidic developers include citric acid, oxalic acid, maleic acid, gluconic acid, acrylic acid, methacrylic acid, malonic acid and the like. Useful complexing developers include the zinc, cobalt, or nickel salts of organic acids such as benzoic acid, napthoic acid, propionic acid, malic acid, and the like.

The location of the developer is not narrowly critical and can vary as long as the developer is carried by the toner particle and separate from the color precursor until release of the color precursor. The developer material may be adsorbed on, bound to, or coated on individual toner particles, giving rise to color-self-developing particles. In another alternative, the developer can be contained inside the toner particles in separate, smaller microcapsules to maintain separation from the color precursor.

The toner particles, composing what is referred to herein as "a toner blend" or "blended toner", typically have a shell and a core. The core preferably contains the color precursor and the photosensitive composition. The shell is generally positively or negatively charged and can be made of various materials known in the art, as detailed below. The shell also may contain a color-developer within or on the surface thereof. A variation on this core/shell morphology comprises a capsule within a capsule, the inner capsule containing, e.g., a leucodye dissolved in a carrier oil and the outer capsule containing at least a photoinitiator dissolved in an ethylenically unsaturated monomer. Typical shell materials include, for example, melamine formaldehyde resins, urea-formaldehyde resins, polyurethanes, polyureas, epoxy polymers, gelatin, dextrans, thermoplastics such as polymethyl methacrylate, polyethylene or polystyrene, waxes and functionalized starches. Encapsulation techniques include in situ polymerization, interfacial polymerization, coacervation, precipitation and spray-encapsulation.

The average size of the microcapsular toner particles is generally between 0.1 and 30 microns, preferably between 1 and 15 microns, and most preferably between 5 and 10 microns.

To render the toner particles capable of electrophoretic deposition, one or more charge directors (designed to impart either a positive or negative surface charge to the particles) are typically used. In addition, in the case of a liquid blended toner in which the particles are suitably suspended in a non-polar hydrocarbon solvent, additives to confer electrosteric stability (dispersing aids) are required. Representative examples of useful dispersing additives include homopolymers and copolymers of lauryl methacrylate, wheat germ oil, soybean oil, sunflower oil, castor oil, Polytergent® B150, cod liver oil, oleic acid, palmitic acid, linseed oil, di(ethylhexyl) phosphoric acid, Wayhib® B, Zelec® UN, cocoamine and the like. These materials are used in amounts of approximately 0.1 to 1.0 wt % versus the toner particles, preferably 0.1 to 0.5 wt %. Representative examples of charge-directing additives include lecithin, copolymers of lauryl methacrylate and vinylpyridine or -picoline, copolymers of lauryl methacrylate and glycidyl methacrylate and the like; their mixtures with alkali and transition metal salts of organic acids, such as calcium dioctylsulfosuccinate and chromium hexadecyl salicylate; as well as mixtures of the above. Useful concentrations of the charge-directors range between 0.01 and 0.5 wt %, preferably between 0.05 and 0.4 wt %.

In the case of a liquid toner in an isoparaffin solvent, the concentration of toner particles has an effect on the quality of the images produced. Concentration of the particles in the dispersion is profitably between 0.5 and 5 wt %, most beneficially between 1 and 3 wt %.

Typically, the core of the toner particles contains photohardenable, photosensitive, radiation-curable, composition(s). The viscosity of the core of the toner particles is increased substantially upon exposure to the appropriate wavelengths of radiation through mechanisms such as crosslinking or polymerization. When the toner particles are ruptured, the photosensitive composition which polymerized upon exposure to radiation will flow very little, if at all, while the unexposed or weakly exposed photosensitive composition can flow relatively freely. As a direct result, the chromogenic material (i.e., the color precursor) reacts with the developer according to the inverse of the degree of exposure to the appropriate wavelength of radiation to form the desired color in the desired image area. Suitable radiation-curable materials include materials curable by free radical-initiated, chain-propagated, addition polymerization or ionic polymerization.

In an alternative embodiment, the photosensitive composition can be a high-viscosity composition which undergoes a substantial decrease in viscosity upon exposure to actinic radiation of the appropriate wavelength. In that case, the chromogenic material located in or on the exposed toner particles, is therefore made accessible to the developer upon rupture of the particles.

Representative photohardenable, photosensitive compositions are ethylenically unsaturated organic compounds. These compounds contain at least one ethylenic group per molecule. Typically they are liquid at room temperature and can also double as a carrier oil for the chromogenic material in the toner core. A preferred group of radiation-curable materials is ethylenically unsaturated compounds having two or more ethylenic groups per molecule. Representative examples of these compounds include ethylenically unsaturated acid esters of polyhydric alcohols such as trimethylolpropane triacrylate or trimethacrylate, acrylate prepolymers derived from the partial reaction of pentaerythritol with acrylic or methacrylic acid or acrylic or methacrylic acid esters; isocyanate-modified acrylate, methacrylic and itaconic acid esters of polyhydric alcohols, etc.

Some typical examples of photosoftenable materials useful in other embodiments are photolysable compounds such as certain diazonium compounds, poly(3-oximino-2-butanone methacrylate) which undergoes main-chain scission upon UV exposure, poly(4'-alkyl acylophenones), and certain resins having a quinone diazide residue.

Photoinitiators are optionally used in accordance with the method of the present invention to selectively photoharden or photosoften the toner particles as desired. The photoinitiator is typically responsive to a specific wavelength and/or amount of actinic radiation. These, alone or in conjunction with a sensitizer, are compounds which absorb the exposure radiation and generate a free radical with or without the aid of a co-initiator. If a system which relies upon ionic polymerization is used, the photoinitiator may be the anion- or cation-generating type, depending on the nature of the polymerization. Suitable free radical photoinitiators include alkoxy phenyl ketones, Michler's ketone, acylated oximinoketones, polycyclic quinones, benzophenones, substituted benzophenones, xanthones, thioxanthones, halogenated compounds such as chlorosulfonyl and chloromethyl polynuclear aromatic compounds, chlorosulfonyl and chloromethyl heterocyclic compounds, chlorosulfonyl and chloromethyl benzophenones and fluorenones, haloalkanes, halophenylacetophenones; photoreducible dye/reducing agent redox couples, photooxidizable dye/oxidant redox couples, ketocoumarins, cyanine borates, halogenated paraffins (e.g., brominated or chlorinated paraffin) and benzoin alkyl ethers.

If used, the amount of photoinitiator employed in the photosensitive composition to initiate polymerization (i.e., photoharden) or depolymerization (i.e., photosoften) of the photosensitive composition in the toner particles will depend upon the particular photosensitive comPosition selected, the particular photoinitiator selected, and the photohardening or photosoftening speed desired. The photoinitiator is preferably employed in an amount of between about 0.001 and about 30 (preferably between about 1 and about 10) weight percent based upon the total weight of the toner particles.

Other additives can be employed in the toner particles such as carrier oils, e.g., deodorized kerosene or alkylated biphenyls. Curing agents can also be used. These are free-radical generators such as thermal initiators, which upon reacting with the photosensitive composition cause it to polymerize or crosslink. After selectively exposing the composition to actinic radiation, and rupturing the particles in the presence of a developer material, the chromogenic material and the developer react to produce color in the form of an image, the curing agent then reacts with the released photosensitive composition and hardens it, thereby preventing image diffusion or degradation. In the case of certain curing agents, it may be desirable to heat the image to accelerate the cure. A curing agent is preferably selected which is relatively inactive at room temperature (for good shelf life) and which is readily activated by heating to temperatures in excess of room temperature.

A particularly useful class of thermal initiators reactive with ethylenically unsaturated compounds are organic peroxides. Suitable peroxides include diacyl peroxides, ketone peroxides, peroxydicarbonates, alkyl peroxides, allyl hydroperoxides and sulfonyl peroxides. Also useful as thermal initiators are bisazides, perborates and diazo compounds. If used, the thermal initiator is preferably employed in an amount of between about 0.1 and about 10 wt % (preferably between about 0.5 and about 5 wt %) based upon the total weight of the toner particles.

The method of the present invention is expected to have commercial application in making full-color prints, transparencies and slides, as well as full-color computer-generated images and full-color xerographic copies.

The above-mentioned patents and patent applications are specifically incorporated herein by reference in their entirety.

The following examples are intended to illustrate, but in no way limit the scope of, the present invention.

EXAMPLE 1

Preparation of Individual Toners, Followed by Toner Blend Preparation and Multicolor Imaging Using the Toner Blend

(A) (1) Aqueous Preparation of Blue-Color-Forming Toner Particles

Blue-color-forming toner particles, which were photosensitive to near-ultraviolet radiation, were prepared in water in the following manner. A solution was prepared by dissolving 5.0 g of ethylene-maleic anhydride copolymer (1:1 mole ratio; 80,000 MW) and 1.0 g of sodium hydroxide in 45.0 g of water with stirring and heating at 90° C. for two hours. Then 100 g of water was added and the solution cooled to 55° C. The pH was adjusted from 4.3 to 4.0 with 10 percent sulfuric acid and the temperature was maintained at 55° C. until the solution was used. The toner core solution was prepared by first mixing 60.14 g of trimethylolpropane triacrylate (TMPTA) and 16.55 g of methyl methacrylate (MMA). To this was added 4.52 g of COPIKEM ® IX (a product of Hilton-Davis), a blue-dye precursor, which was dissolved by heating to 75° C. and stirring. After the dye precursor was dissolved, this solution was allowed to cool to room temperature. Then 5.20 g of Michler's ketone, a UV-sensitive photoinitiator, was added with stirring that was continued until the photoinitiator dissolved. 37.35 g of CYMEL(®) 385 (a modified melamine-formaldehyde resin, a product of American Cyanamid) was warmed to about 50° C.

The solution of ethylene-maleic anhydride copolymer was added to a jacketed blender which was heated to 55° C. by means of circulated water. The blender power setting was controlled to 40 volts by means of a variable transformer. Next, the core solution was added and the blender power setting was increased to 90 volts for 45 seconds to disperse the core liquid into small droplets. The blender power was reduced to 40 volts and the CYMEL(®) 385 (a modified melamine-formaldehyde resin, a product of American Cyanamid) was added to the blender. Stirring and heating at 55° C. were then continued for two hours.

The blue-color-forming toner particles were later isolated as a dry powder by spray drying.

By an analogous procedure, yellow-color-forming toner particles were prepared using REAKT® (a product of BASF Corporation) as the dye precursor. Also, black-color-forming particles were prepared using COPIKEM ®IV (a product of Hilton-Davis) as the dye precursor.

(A) (2) Aqueous Preparation of Magenta-Color-Forming Toner Particles

Magenta-color-forming toner particles, which were photosensitive to blue light, were prepared in water in the following manner. A solution was prepared by dissolving 5.0 g of ethylene-maleic anhydride copolymer and 1.0 g of sodium hydroxide in 45.0 g of water by stirring and heating at 85° C. for two hours. To this was added 100 g of water and the temperature was adjusted to 55° C. The pH was adjusted from 4.27 to 4.00 with 10 percent sulfuric acid and the temperature was maintained at 55° C. until the solution was used. The toner core solution was prepared by first mixing 60.12 g of trimethylolpropane triacrylate and 16.32 g of methyl methacrylate. To this was added 4.52 g of COPIKEM(®) XX (a product of Hilton-Davis), a magenta dye precursor, which was dissolved by heating to 75° C. and stirring. After the dye precursor dissolved, the mixture was cooled to room temperature and 2.32 g of camphorquinone and 2.69 g of NUVOPOL-®EMBO (a product of Aceto Chemical Co.) were added. Stirring was continued until the photoinitiator and hydrogen doner dissolved.

The solution prepared from the ethylenemaleic anhydride copolymer was added to a jacketed blender which was heated and maintained at 55° C. by means of circulated water. The blender power setting was controlled to 40 volts by means of a variable transformer. Next, the core solution was added and the blender power setting was increased to 90 volts for 45 seconds to disperse the core liquid into small droplets. The blender power was reduced to 40 volts and 37.22 g of CYMEL(®) 385 which had been preheated to about 50° C., was added to the blender. Stirring and heating at 55° C. were then continued for two hours.

The magenta-color-forming toner particles were later isolated as a dry powder by spray drying.

(B) Preparation of the Toner Blend and Electrostatic Photoselective Formation of a Multicolored Image A liquid blended toner was prepared by combining 2.0 g of the dry, blue-color-forming toner powder prepared as in Section (A) (1), 2.0 g of the dry, magenta-color-forming toner powder prepared as in Section (A) (2), and 196 g of a liquid hydrocarbon having a low dielectric constant, ISOPAR G(®) (a product of Exxon Chemical Company). This mixture was first stirred in a beaker and then transferred to a jar and shaken.

A charged latent image was formed on a sheet of dielectric paper (4008F® Electrographic Paper, a product of Versatec Inc.) by means of a steel piece, 1-½ inches wide by 3 inches long, which was connected to a DC power supply set at 750 volts. The dioelectric paper was laid on a flat aluminum ground plate and the steel piece, which was connected to the positive lead from the power supply, was held in contact with the paper surface for 60 seconds with the power on. The paper was then dipped into the liquid blended toner. Upon removal of the paper, a non-colored toned image was visible which exactly corresponded in area and location to the place of contact by the charged, steel piece. The toned image on the sheet was allowed to dry at room temperature.

Color-imagewise exposure of the non-colored, toned image was carried out in the following manner (see TABLE I below). The area upon which the toner had been deposited was covered by a contact mask (Mask A) which was subdivided into four areas with Areas 1 and 4 being opaque and Areas 2 and 3 being transparent. The mask was then covered with a glass, band-pass filter (Filter A) (Model No. 51800, a product of Oriel Corporation) which only passed light having wavelengths between 225 and 400 nm (UV). The toned image area was then irradiated through Filter A and Mask A with a mercury lamp. Thus, Areas 2 and 3 were exposed to light of 225–400 nm and Areas 1 and 4 were not. Filter A and Mask A were then removed and the toned image area was then covered by a mask (Mask B). Mask B had four areas corresponding to Areas 1–4 of Mask A except that in Mask B, Areas 1 and 3 were opaque and Areas 2 and 4 were transparent. This mask was then covered with a glass, long-pass filter (Filter B) (Model No. 51482, a product of Oriel Corporation) which only passed light with wavelengths greater than 420 nm. The toned image area was then irradiated through Filter B and Mask B with the same mercury lamp as before. Thus, Areas 2 and 4 were exposed to light of wavelengths greater than 420 nm and Areas 1 and 3 were not. Filter B and Mask B were then removed.

In the areas exposed to the UV light (225–400 nm through Filter A), the blue-color-forming toner particles were hardened because they contained a photoinitiator sensitive to the UV light. In the areas exposed to light of wavelength greater than 420 nm, the magenta-color-forming toner particles were hardened because they contained a photoinitiator sensitive to blue light.

The toned image area was then placed in contact with a developer sheet (20#, white, NCR paper (TM) supplied by Appleton Papers, Inc.) and pressure was then applied to rupture the toner particles that had not been hardened. This resulted in an image that had purple (subtractive combination of blue and magenta), white, magenta, and blue areas. The purple color was produced in Area 1, which was not irradiated in either exposure. Thus, neither type of toner particle was hardened. The white region was produced in Area 2 which was irradiated by both exposures, thus hardening both types of toner particles. The magenta color was produced in Area 3, which was irradiated during only the first exposure, thus causing only the blue-color-forming toner particles to be hardened. The blue color was produced in Area 4, which was irradiated during only the second exposure, thus causing only the magenta-color-forming toner particles to be hardened.

The results in terms of the color produced for each of the various areas of the image are summarized in TABLE I following.

TABLE I

| Area | Mask A | First Exposure Filter A nm | Mask B | Second Exposure Filter B nm | Color-Former Hardened | Color Produced |
|---|---|---|---|---|---|---|
| 1 | opaque | — | opaque | — | none | purple |
| 2 | transparent | 300–400 | transparent | 420 | both | white |
| 3 | transparent | 300–400 | opaque | — | blue | magenta |
| 4 | opaque | — | trans- | 420 | magenta | blue |

TABLE I-continued

| Area | Mask A | First Exposure Filter A nm | Mask B | Second Exposure Filter B nm | Color-Former Hardened | Color Produced |
|---|---|---|---|---|---|---|
| | | | parent | | | |

Note that the resulting colors included purple, magenta, and blue, as well as a portion of the image having the white coloration of the paper.

EXAMPLE 2

Spray Drying an Aqueous Suspension of Toner Particles Treated With Citric Acid and Demonstration of Color-Self-Developing Using These Particles 20 ml of an aqueous suspension of magenta-color-forming toner particles containing approximately 20 percent solids was diluted by 50 percent with water. To this was added 1.0 g of anhydrous citric acid. The mixture was stirred for 15 minutes at room temperature to dissolve the citric acid. Next the solution was spray dried and the solids, slightly pink particles, were collected. Scraping or crushing the particles against a sheet of plain paper caused the development of a deep magenta color.

EXAMPLE 3

Preparation of Color-Self-Developing Toner Particles in a Non-Aqueous Medium and Color Development Therewith Another approach to produce color-self-developing toner particles was to dissolve the citric acid in THF (tetrahydrofuran) and add this to the particles along with a dispersant. The system was then diluted with ISOPAR ® G, an isoparaffinic liquid, and the THF was removed by rotary evaporation. A batch of these particles was prepared by treating 0.1 g of particles with five drops of a 1 percent solution of citric acid in THF (1.8 mg citric acid). 0.05 g ZELEC ® UN (an acidic phosphate ester, a product of E. I. du Pont de Nemours & Co.) was also added as a dispersant. The mixture was then diluted with 10 g of ISOPAR ® and the THF was removed. These toner particles were applied to plain paper. After evaporation of the ISOPAR ®, a weighing paper was placed on top of this sheet and pen pressure was applied. This resulted in magenta-colored lines developing on the plain paper.

EXAMPLE 4

Preparation of a Color-Self-Developing Toner Blend and Electrostatic, Photoselective Formation of A Multi-Colored Image Magenta-forming, color-self-developing toner particles and yellow-forming, color-self-developing toner particles were isolated as a powder by spray-drying as in Example 1 or 2. A mixture of spray-dried, color-self-developing toner particles, made up of one part magenta-forming particles and one part yellow-forming particles, was prepared. 3.0 g of a 5 percent ISOPAR ® H solution of SOLSPERSE ® 21000 (a dispersant manufactured by ICI) were added to 1.17 g of the toner particle mixture. 60 of ISOPAR ® H were added and the entire mixture sonicated to form a dispersion of toner particles. 0.2 g of ZELEC® UN in 5 mL of ISOPAR® H isoparaffinic liquid were added, followed by further sonication. The resulting toner particle dispersion was utilized as a toner blend to produce images electrostatically.

A latent image was formed on a piece of dielectric paper (4008-F® electrographic paper, a Product of Versatec, Inc.) using a corona-charging technique. A sheet of MYLAR® having the letter "O" cut into it was laid on the dielectric paper. A corona connected to a +9000 V power supply was passed over the cut-out region several times, resulting in the formation of a charged area of the paper in the shape of the cut-out "O". The dielectric paper was immersed in the above toner blend for several seconds. The paper, bearing a toned, colorless image was then dried to remove ISOPAR® H isoparaffinic liquid by briefly placing it in an oven at a temperature of 80° C.

A portion of the toned image was covered by an opaque mask and the paper was exposed to the output of a 100 W BLAK-RAY® lamp (manufactured by Ultra-Violet Products) for two minutes at a distance of 5 inches. The light was filtered using a long-pass filter that allowed only wavelengths longer than 420 nm to pass (Oriel Corporation, Model #51482). The yellow-forming, self-developing toner particles, containing camphoroquinone (a photoinitiator sensitive to 480±20 nm light) were hardened in the irradiated regions. The magenta-forming, self-developing toner particles were not hardened in either the irradiated or masked regions of the toned image, since these magenta-forming particles contained Michler's ketone as a photoinitiator to make these particles sensitive to 350±40 nm light.

The selectively hardened toned image on the paper was run through a nip roll, after covering the toned image with a Piece of weighing paper to prevent toner particles sticking to the rolls during pressure development. The final electrostatically produced image was red where it had been shielded from the light (the subtractive combination of magenta and yellow) and magenta where the yellow-forming, self-color-developing toner particles had been hardened by irradiation.

EXAMPLE 5

Incorporation of Photohardenable Toner Particles Containing Rose Bengal bis(Dioctylammonium Salt) Into A Three-Color Blended Liquid Toner A three-color, liquid, blended toner was prepared by combining 7.4 g, blue-color-forming toner powder (hardenable by near UV light), 7.4 g dry, yellow-color-forming toner powder (hardenable by blue light) and 14.8 g of dry, magenta-color-forming toner powder (as prepared in Example 4; hardenable by green light) with 2220 g of ISOPAR® G. The former two kinds of toner particles are prepared according to USSN 171,614, Section (A)(1) and Section (A)(2). Polymer III part C (46.6 g, an Olin Hunt product) was added as a dispersing aid and charging agent. The toner was placed in an ultrasonic bath in order to disperse the toner particles. The toner was then transferred to a plastic jug for storage. The above three-color toner was added to a Savin 895 LTT photocopier. The paper tray was loaded with 20# NCR paper. The target used to image the three-color toner was a rectangular block containing 0.5 inch black squares. After depressing the print button on the Savin 895, output from the copier was received in the form of a colorless, toned image consisting of a mixture of all three constituent toner particle types deposited on the NCR paper to duplicate the target image. This target was used for convenience, but in principle any such image maY be reproduced by this electrostatic method. Excess ISOPAR® G was allowed to evaporate, then the individual squares were selectively photohardened in a manner similar to that described in USSN 171,614 Section (B). The intensity of the filtered light had to be increased by moving the lamp from a distance of 6 inches to approximatelY 2 inches. This was due to the thickness of the toned image produced by the Savin 895 LTT photocopier. The selectively photohardened, toned image on the NCR paper was then passed through a set of nip rolls in order to rupture the unhardened toner particles. The colors obtained in each of the individual squares of the image are listed in the table below.

| FILTER | HEIGHT | EXPOSURE TIME | COLOR |
|---|---|---|---|
| Long pass 435 nm | 2 inch | 30 seconds | Blue |
| Band pass 370 nm | 2 inch | 5 seconds | Magenta* |
| Interfer. 480 nm | 2 inch | 60 seconds | |
| Band pass 355 nm | 6 inch | 10 seconds | Red |
| Long pass 530 nm | 6 inch | 600 seconds | Yellow* |
| Band pass 355 nm | 6 inch | 10 seconds | |
| White Light | 6 inch | 180 seconds | White |

*Required the referenced two exposure times to produce the desired color.

EXAMPLE 6

Evaluation of Various Despersants Used in the Preparation of Liquid Toners

These samples were prepared by weighing out the dry capsules at the designated weight percent and then adding a small quantity of Isopar 110 H to the capsules along with the designated weight of dispersant. The mixture was then placed into an ultrasonic bath and agitated for approximately three to five minutes to disperse the capsules and to coat the capsules with the dispersant. Then the remaining Isopar H was added to the mixture and the solution was returned to an ultrasonic bath to further disperse the capsules. The following is a table listing the type and amount of dispersant along with the type and amount of capsules used in the test. The dispersion quality is described along with the electrostatic behavior of the prepared toner. Most images were produced by hand-charging dielectric paper with a corona and then dipping the charged paper into the prepared liquid toner.

COLOR TONOR FORMULATIONS
NSD = NON-COLOR-SELF-DEVELOPING CAPSULES
SD = COLOR-SELF-DEVELOPING CAPSULES

| CAPSULES | DISPERSENTS | CHARGE ADDITIVES | TONER QUALITY | DISPERSION QUALITY | IMAGE |
|---|---|---|---|---|---|
| NSD (0.8%) 2.5-8.0 | LAURYL METHACRYLATE | — | — | FAIR | — |

-continued

COLOR TONOR FORMULATIONS
NSD = NON-COLOR-SELF-DEVELOPING CAPSULES
SD = COLOR-SELF-DEVELOPING CAPSULES

| CAPSULES | DISPERSENTS | CHARGE ADDITIVES | TONER QUALITY | DISPERSION QUALITY | IMAGE |
|---|---|---|---|---|---|
| MICRONS | $M_W$ = 158,300 0.4% | | | | |
| NSD (0.8%) 2.5–8.0 MICRONS | LAURYL METHACRYLATE $M_W$ = 108,400 0.4% | — | — | FAIR | — |
| NSD (0.8%) 2.5–8.0 MICRONS | WHEAT GERM OIL 0.20% | — | NEGATIVE | GOOD | — |
| NSD (0.8%) 2.5–8.0 MICRONS | SOYBEAN OIL 0.4% | — | — | FLOCCULATED | — |
| NSD (0.8%) 2.5–8.0 MICRONS | SUNFLOWER OIL 0.4% | — | — | FLOCCULATED | — |
| NSD (0.8%) 2.5–8.0 MICRONS | CASTOR OIL 0.4% | — | — | GOOD (HARD-SETTLING) | — |
| NSD (0.8%) 2.5–8.0 MICRONS | POLYTERGENT B150 0.4% | — | — | FLOCCULATED | — |
| NSD (0.8%) 2.5–8.0 MICRONS | COD LIVER OIL 0.4% | — | — | GOOD (HARD-SETTLING) | — |
| NSD (0.8%) 2.5–8.0 MICRONS | OLEIC ACID 0.4% | — | — | GOOD (HARD-SETTLING) | — |
| SD (0.8%) 2.5–8.0 MICRONS | PALMITIC ACID 0.4% | — | — | FLOCCULATED | — |
| NSD (0.8%) 2.5–8.0 MICRONS | LINSEED OIL 0.4% | — | — | FLOCCULATED | — |
| NSD (0.8%) 2.5–8.0 MICRONS | DI(ETHYL HEXYL) PHOSPHORIC ACID 0.4% | — | — | QUICKLY SETTLED | — |
| NSD (0.8%) 2.5–8.0 MICRONS | WAYHIB B 0.4% | — | — | FLOCCULATED | — |
| NSD (1.0%) 2.5–8.0 MICRONS | ZELEC UN 0.05% | — | POSITIVE | GOOD (REDIS-PERSIBLE) | GOOD |
| NSD (0.8%) 2.5–8.0 MICRONS | COCOAMINE 0.4% ZELEC UN 0.4% | — | POSITIVE | EXCELLENT-FINE PARTICLES | GOOD; POOR COLOR; SMALL CAPSULES |
| NSD (1.0%) 5.0–10 MICRONS | — | CHEM 451 0.25% | POSITIVE | GOOD (REDIS-PERSIBLE) | GOOD; HIGH RESO-LUTION |
| SD (1.0%) 5.0–10 MICRONS | ZELEC UN 0.2% | POLYMER III PART C 0.325% | NEGATIVE | GOOD | GOOD |
| NSD (1.0%) 5.0–10 MICRONS | — | POLYMER III PART C 0.325% | NEGATIVE | GOOD | GOOD |
| SD (1.0%) 5.0–10 MICRONS | ZELEC UN 0.2% | LECITHIN 0.05% | NEGATIVE | GOOD | GOOD (SOME CRACKING) |
| SD (2.0%) 5.0–10 MICRONS | SOLSPRSE 13940 (0.5%) ZELEC UN 0.175% | — | NO CHARGE | HARD TO REDISPERSE | — |
| SD (1/95%) 5.0–10 MICRONS | SOLSPERSE 21000 (0.25%) ZELEC UN | — | NEGATIVE | VERY GOOD | VERY GOOD; IMPROVED CENTER FILL |
| SD (2.0%) 5.0–10 MICRONS | SOLSPERSE 21000 (0.33%) LECITHIN (0.06%) | — | NEGATIVE | HARD TO RE-DISPERSE | STREAKED IMAGES |
| SD (2.0%) 5.0–10 MICRONS | SOLSPERSE 21000 (0.5%) WHEAT GERM | — | NEGATIVE | GOOD | GOOD (CENTER FILL WEAK) |

-continued

| COLOR TONOR FORMULATIONS<br>NSD = NON-COLOR-SELF-DEVELOPING CAPSULES<br>SD = COLOR-SELF-DEVELOPING CAPSULES | | | | | |
|---|---|---|---|---|---|
| CAPSULES | DISPERSENTS | CHARGE ADDITIVES | TONER QUALITY | DISPERSION QUALITY | IMAGE |
| | OIL (0.25%) | | | | |

| LARGE BATCHES OF TONER FOR SAVIN 895 COPIER | | | | | |
|---|---|---|---|---|---|
| CAPSULES | DISPERS. | CHARGE/DIR. | Q/M | CONDUCT. | RESULTS |
| 72773<br>SD-1.2%<br>10+<br>MICRONS<br>Many agglomerates | WHEAT GERM 0.15% | SOLSPERSE 21000 (0.21%) | ANODE 0.0054 g<br>CATH. 0.0014 g<br>ANODE 0.0089 g<br>CATH. 0.0011 g | 1520 pmho<br>1740 pmho | Dip image was good Savin copy very light; settling, large part. size, low conductivity |
| 72775<br>NSD-0.95%<br>10<br>MICRONS | None | POLYMER III PART C 0.19% | ANODE 0.0050 g<br>CATH. NONE<br>ANODE 0.0056 g<br>CATH. NONE | 2540 pmho<br>2850 pmho | Savin copy was darker, good resolution. |

EXAMPLE 7

Three-Color, Negative Toner

Imaged on Dielectric Paper

A three-color negative toner was prepared by weighing out into a bottle 0.26 grams of yellow capsules (containing camPhorquinone/Nuvopol/yellow dye precursor), 0.26 grams blue capsules (containing Michler's ketone/blue dye precursor) both having Cymel wall material and, 0.26 grams magenta capsules (containing RBDO/magenta dye precursor) contained within a starch wall material. The above capsules were in a dry state from a previous spray-drying step. To the combined capsules was then added 10 grams of Isopar H. The bottle was then placed into the ultrasonic bath for three minutes to disperse the capsules in the solvent. Next 0.63 grams of PLMA/FM-2/HEMA, a negative charge director, composed of an amine-containing polymer, was added to the mixture. The bottle was then returned to the ultrasonic bath for another three minutes. The solution was then diluted with an additional 70 grams of Isopar H and returned to the ultrasonic bath for five minutes. A plastic template having a quarter-inch wide opening approximately four inches long was placed on top of a piece of dielectric paper. A positively charged corona (9000 volts) was passed over this opening. The charged paper was then placed into the bottle containing the three-color, negatively charged toner. The particles could be seen deposited onto the dielectric paper only in the charged area. The paper was then dried with a heat gun to remove any Isopar H. A range of colors was produced by exposing sections of this strip to various wavelengths of light using selected filters. The colors were developed by crushing the imaged paper against citric acid-treated NCR paper. The following is a list of filters, exposure times and the resulting colors:

| FILTER | EXPOSURE TIME | COLOR |
|---|---|---|
| Long pass 530 nm | 600 seconds | Green |
| Band pass 355 nm | 10 seconds | Red |

-continued

| FILTER | EXPOSURE TIME | COLOR |
|---|---|---|
| Long pass 435 nm | 120 seconds | Blue |
| Interfer. 480 nm | 1 hour | Purple |
| Long pass 530 nm | 600 seconds | Yellow |
| Band pass 355 nm | 10 seconds | |
| Band pass 370 nm | 30 seconds | Magenta |
| White Light | 60 seconds | White |
| — | No Exposure | 3-Color Combination |

*Required the referenced two exposure times to produce the desired color.

EXAMPLE 8

Three-Color, Positive Toner

Imaged on Dielectric Paper

(A) Toner Preparation

A three-color, positive toner was prepared by weighing out the following capsule amounts into a bottle. 0.53 grams of yellow capsules (containing camphorquinone/Nuvopol/yellow dye precursor), 0.53 grams cyan capsules (containing Michler's ketone/cyan dye Precursor) and 1.06 grams magenta capsules (containing RBDO/magenta dye precursor). The above materials were in a dried powder form. 20 grams of Isopar H was added to the above capsules along with 0.40 grams of chem 451 (a chrome-containing positive charge director). The bottle was then placed into an ultrasonic bath for three minutes to disperse the capsules and to coat the capsules with the charge-directing agent. Finally the solution was further diluted with an additional 60 grams of Isopar H. The bottle was again returned to the ultrasonic bath for five minutes.

(B) Imaging and Color-Development Using the Above Toner

A plastic template containing a series of ellipse-shaped openings was placed on top of dielectric paper. A negative corona (7000 volts) was activated and passed over the template. The charged dielectric paper was then dipped into the above toner for approximately 30 seconds. The toner particles could be seen coating the previously charged areas of the paper. The excess Isopar was removed by use of a heat gun. The color of each ellipse was determined by exposure of the electrostatically deposited capsules to selected wavelengths of light. Following is a listing of the wavelengths, exposure times and resulting colors.

| FILTER | EXPOSURE TIME | | COLOR |
|---|---|---|---|
| Long pass 435 nm | 30 sec | (Increased Intensity Required) | Blue |
| Band pass 370 nm | 5 sec | (Increased Intensity Required) | Magenta |
| Interfer. 480 nm | 60 sec | | Red* |
| Band pass 355 nm | 10 sec | | |
| Long pass 530 nm | 600 sec | | |
| Band pass 355 nm | 10 sec | | Yellow* |
| White Light | 180 sec | | White |

*Required the referenced two exposure times to produce the desired color.

EXAMPLE 9

Three-Color, Positive Toner Image Using A Versatec Electrostatic Printer/Plotter

(A) Toner Preparation

A three-color, positive toner was prepared by weighing out the following capsule amounts into a bottle. 1.06 grams of yellow capsules (containing camphorquinone/Nuvopol/yellow dye precursor, 1.06 cyan capsules (containing Michler's ketone/cyan dye precursor) and 2.12 grams magenta capsules (containing RBDO/magenta dye precursor). The above materials were in a dry powder state. Next 10 grams of Isopar H was added to the above capsules along with 0.80 grams of Chem 451, a chrome-containing, positive charge-directing agent. The bottle was then placed into an ultrasonic bath for three minutes to disperse the capsules and to coat them with the charge-directing agent. Then 50 grams of Isopar H were added to the above toner formulation. The bottle was then returned to the ultrasonic bath for an additional three minutes.

(B) Imaging With the Versatec Electrostatic Printer/Plotter

A Model D1100A Versatec Printer/Plotter (a product of Versatec, Inc.) was set up to produce quarter-inch wide lines across the dielectric paper. This was done after the black toner reservoir had been disconnected from the printer so that the paper was charged negatively but not developed with the commercial toner. A section of this paper was taken from the printer and dipped into the above three-color toner bath for approximately 30 seconds. The paper was removed and dried to remove the Isopar. Next the toned quarter-inch strip was covered and sections of it were exposed to selected wavelengths of light. Below is a list of the exposure times, wavelengths and colors produced after crushing the imaged strip.

| FILTER | EXPOSURE TIME | | COLOR |
|---|---|---|---|
| Long pass 435 nm | 30 sec | (Increased Intensity Required) | Blue |
| Band pass 370 nm | 5 sec | (Increased Intensity Required) | Magenta |
| Interfer. 480 nm | 60 sec | | Red* |
| Band pass 355 nm | 10 sec | | |
| Long pass 530 nm | 600 sec | | Yellow* |
| Band pass 355 nm | 10 sec | | |

-continued

| FILTER | EXPOSURE TIME | COLOR |
|---|---|---|
| White Light | 180 sec | White |

*Required the referenced two exposure times to produce the desired color.

The colors were developed by crushing the strip against a sheet of ink jet paper coated with a slurry containing zinc salicylate and a novolak resin. Crushing was performed on a set of heated nip rolls.

The preceding imaging experiments were also performed using two- or three-color, self-developing toners in the place of the non-self-developing toners. The toner particles were prepared as in examples 2 and 3, and NCR paper was not required for color-development during final pressure-rupture of the toner particles: crushing of the toned images against plain paper yielded the final, multicolor image. Alternately, a sheet of Mylar interposed between the toned image and the nip rolls gave a multicolor image on the substrate bearing the toned image.

What is claimed is:

1. A blend of microcapsular toner particles, each of said microcapsular toner particles being an electrostatically depositable, microcapsular toner particle comprising a shell and a core, said shell being fabricated of a polymer, and said core at least comprising as a color precursor a colorless, chromogenic material, and additionally containing a radiation-sensitive material, said chromogenic material being capable of becoming colored upon contact with a developer, said shell posessing a charge characteristic to render said toner particle electrostatically depositable, the shell of said toner particle being rupturable to release said chromogenic material, said blend comprising at least two types of toner particles, each of said types containing a color precursor and additionally containing a photosensitive composition that is light-active at wavelengths distinct from the wavelengths of light activity of the other types of toner particles in the blend, and wherein the particles are dispersed in a non-polar isoparaffinic solvent.

2. The toner-particle blend of claim 1 wherein the particle dispersion is stabilized with at least one member selected from the group consisting of: homopolymers and copolymers of alkyl esters of acrylic acid or methacrylic acid; naturally occurring oils; surfactants; fatty acids; a dialkylhexylphosphoric acid derivative; cocoamine; phosphate esters and derivatives thereof; metal succinates or metal salicylates or derivatives thereof; and combinations thereof.

3. A blend of microcapsular toner particles, each of said microcapsular toner particles being an electrostatically depositable, microcapsular toner particle comprising a shell and a core, said shell being fabricated of a polymer, and said core at least comprising as a color precursor a colorless, chromogenic material, and additionally containing a radiation-sensitive material, said chromogenic material being capable of becoming colored upon contact with a developer, said shell possessing a charge charactertistic to render said toner particle electrostatically depositable, the shell of said toner particle being rupturable to release said chromogenic material, said blend comprising at least two types of toner particles, each of said types containing a color precursor and additionally containing a photosensitive composition that is light-active at wavelengths distinct from the wavelengths of light activity of the other types of toner particles in the blend, and wherein the toner particles are isolated by spray-drying prior to blending.

4. A developer-bearing, color-self-developing, electrostatically depositable, microcapsular toner particle comprising a shell and a core, said shell being fabricated of a polymer, and said core at least comprising as a color precursor a colorless, chromogenic material, and additionally containing a radiation-sensitive material, said chromogenic material being capable of becoming colored upon contact with a developer, said shell possessing a charge characteristic to render said toner particle electrostatically depositable, said shell additionally bearing a developer on the outer surface thereof, the shell of said toner particle being rupturable to release said chromogenic material.

5. A blend of microcapsular toner particles as in claim 4 wherein said blend comprises at least two types of toner particles, each of said types containing a color precursor, each of said types of toner particles additionally containing a photosensitive composition that is light-active at wavelengths distinct from the wavelengths of light-activity of the other types of toner particles in the blend.

6. The blend of claim 5 which comprises at least three types of toner particles, each of said types containing a different color precursor selected from the group consisting of cyan, yellow, magenta and black.

7. The toner particles of claim 4 wherein the radiation-sensitive material of the core comprises an ethylenically unsaturated, free-radically polymerizable compound and a photoinitiator.

8. The toner particle of claim 7 wherein said polymerizable compound is an alkanediol diacrylate such as hexanediol diacrylate or decanediol diacrylate; trimethylolpropane triacrylate or other polyacrylates; or a mixture of trimethylolpropane triacrylate and methyl methacrylate.

9. The toner particles of claim 7 wherein said photoinitiator is a benzophenone derivative, a geminate diketone, an organosoluble xanthene dye derivative, a ketocoumarin, an organosoluble thiazene dye derivative, a cyanine borate, or a combination thereof.

10. The toner-particle blend of claim 5 wherein the particles are dispersed in a non-polar, isoparaffinic solvent.

11. The toner-particle blend of claim 10 wherein the particles are between 1 and 20 microns in diameter.

12. The toner-particle blend of claim 5 wherein the particles are present in an amount from 0.5 to 4 wt %.

13. The toner-particle blend of claim 5 wherein the particle dispersion is stabilized with at least one member selected from the group consisting of: homopolymers and copolymers of alkyl esters of acrylic acid or methacrylic acid; naturally occurring oils; surfactants; fatty acids; a dialkylhexylphosphoric acid derivative; cocoamine; phosphate esters and derivatives thereof; metal succinates or metal salicylates or derivatives thereof; and combinations thereof.

14. The toner-particle blend of claim 5 wherein said charge characteristic is imparted to said particles by contact with at least one member selected from the group consisting of lecithin; poly(lauryl methacrylate-co-vinylpyridine) or poly(lauryl methacrylate-co-vinylpicoline) in combination with chromium tris(hexadecylsalicylate) and calcium dioctylsulfosuccinate ; and poly(lauryl methacrylate-co-glycidyl methacrylate).

15. The toner-particle blend of claim 5 wherein the toner particles are isolated by spray-drying prior to blending.

16. The toner particles of claim 4 wherein the developer is an acidic developer or a complexing developer.

17. The toner particles of claim 4 wherein said developer is an acidic developer selected from the group comprising citric acid oxalic acid, maleic acid and its polymers and copolymers, gluconic acid, acrylic acid and its polymers and copolymers, methacrylinc acid and its polymers and copolymers, and malonic acid.

18. The toner particle of claim 4 wherein said developer is a complexing developer selected from the group comprising zinc, cobalt and nickel salts of organic acids.

19. The toner particle of claim 4 wherein said developer is zinc salicylate

20. The toner-particle blend of claim 5 wherein the toner particles are isolated by spray-drying prior to blending.

21. The toner particle blend of claim 5 which is prepared by spray drying an aqueouse dispersion of toner particles in the presence of a developer.

22. The blend of claim 21 which is prepared by the addition of said developer, dissolved in a solvent for the developer, to a toner-particle dispersion in a non-polar, isoparaffinic solvent, followed by removal of said solvent for said developer.

* * * * *

UNITED STATES PATENT AND TRADEMARK OFFICE

CERTIFICATE OF CORRECTION

PATENT NO. : 5,015,549

DATED : May 14, 1991

INVENTOR(S) : Grosso et al

It is certified that error appears in the above-identified patent and that said Letters Patent is hereby corrected as shown below:

In column 3 at line 12 change "Precursor" to --precursor--; at line 20 change "suitablY" to --suitably--;

In column 4, at line 20 change "tYPe" to --type--;

In column 8, at line 36 change "comPosition" to --composition--;

In column 10, at line 19 change "COPIKEM® XX" to --COPIKEM® XX--; at line 36 change "CYMEL® 385" to --CYMEL® 385--; at line 51 change "ISOPAR G®" to --ISOPAR® G-- and at line 60 change "dioelectric" to --dielectric--;

In column 13 at line 8 change "Product" to --product--; at line 37 change "Piece" to --piece-- and at line 55 delete "as prepared in Example 4"and replace with --having as photoinitiator rose bengal bis(dioctylammonium salt)/ dimedone--;

UNITED STATES PATENT AND TRADEMARK OFFICE

CERTIFICATE OF CORRECTION

PATENT NO. : 5,015,549

DATED : May 14, 1991

INVENTOR(S) : Grosso et al

It is certified that error appears in the above-identified patent and that said Letters Patent is hereby corrected as shown below:

In column 14, at line 13 change "maY" to --may-- and at line 19 change "approximatelY" to --approximately--;

In column 17, at line 33 change "camPhorquinone" to --camphorquinone--;

In column 18, at line 49 change "Precursor" to --precursor--; at line 53 change "chem 451" to --Chem 451--;

In column 22, at line 19 add the punctuation mark --.-- after "salicylate" and at line 40 change "aqueouse" to --aqueous--.

Signed and Sealed this

Twentieth Day of April, 1993

*Attest:*

MICHAEL K. KIRK

*Attesting Officer*

*Acting Commissioner of Patents and Trademarks*